US007197154B2

(12) United States Patent
Sahyoun

(10) Patent No.: US 7,197,154 B2
(45) Date of Patent: Mar. 27, 2007

(54) METHOD AND AUDIO SPEAKER WITH MINIMIZATION OF WOBBLE OF THE VOICE COIL

(76) Inventor: Joseph Y. Sahyoun, 3031 Hopkins Ave., Redwood City, CA (US) 94062

( * ) Notice: Subject to any disclaimer, the term of this patent is extended or adjusted under 35 U.S.C. 154(b) by 342 days.

(21) Appl. No.: 10/847,680

(22) Filed: May 17, 2004

(65) Prior Publication Data

US 2004/0240701 A1 Dec. 2, 2004

(51) Int. Cl.
*H04R 25/00* (2006.01)

(52) U.S. Cl. ..... 381/404; 381/403

(58) Field of Classification Search ..... 381/396, 381/398, 403–405, 407, 423, 424
See application file for complete search history.

(56) References Cited

U.S. PATENT DOCUMENTS 5,323,469 A * 6/1994 Scholz ..... 381/403
6,173,065 B1 * 1/2001 Lin ..... 381/398

* cited by examiner

*Primary Examiner*—Suhan Ni
(74) *Attorney, Agent, or Firm*—Allston L. Jones

(57) ABSTRACT

Speaker design/method positively centering speaker components one with the other with a unique design of the surround and radiator. Surround has a main body extending radially through more than 180°, extending from the body there is a flat outer ring and a flat inner ring at substantially 180° radially around the body from the outer ring with a portion of the main body extending below the inner ring, forming a channel between the inner ring and the body portion that extends below it. The radiator has outer and inner edges with a central opening defined by the inner edge, with the outer edge either blunt or defined by a short downward extending ring. The shape and dimensions of the outer edge of the radiator and the channel are substantially the same outer with the radiator edge fitting snugly within the surround channel.

32 Claims, 18 Drawing Sheets

METHOD AND AUDIO SPEAKER WITH MINIMIZATION OF WOBBLE OF THE VOICE COIL

CROSS REFERENCE

This application claims priority co-pending application having Ser. No. 10/646,548 filed Aug. 21, 2003, which is an application claiming priority from U.S. provisional application having Ser. No. 60/405,416 filed Aug. 21, 2002.

BACKGROUND OF THE INVENTION

1. Field of the Invention

This invention relates to passive radiators and audio loud speakers, in particular to the construction of same with minimization of flexure of the radiator and wobble minimization of the voice coil throughout the full range of inner and outer travel of the radiator during operation.

2. Description of the Related Art

In an audio speaker, or transducer, the closer together the points on the speaker frame, or basket, to which the suspension and spider are connected the greater the possibility of rocking, or wobble of the voice coil tube, or bobbin, with respect to the magnet during operation of the speaker. In a conventional speaker, the suspension is attached between the mouth of the basket and the outer diameter of the cone with the spider deeper in the basket beneath the surround. Wobble of the voice coil results from flexing of the speaker cone during operation as opposed to an even push or pull being exercised by the voice coil around the circumference where it connects to the speaker cone. When the cone is flexed, the upper end of the voice coil tube where it attaches to the cone and the lower end of that tube surrounding the magnet are no longer directly above each other with respect the central axis of the speaker. Stated another way, when wobble occurs the central axis of the voice coil bobbin momentarily is not coincident with the central axis of the speaker, i.e., the central axis of the voice coil bobbin is not parallel to the central axis of speaker. Thus, when the cone flexes and the voice coil bobbin wobbles, unwanted distortions occur in the sound waves being reproduced by the speaker. Such distortion effects are often audible to the listener. Since the human ear does not have a flat response to all frequencies, the audio frequency where the mechanical distortion occurs and the percentage of distortion created determines whether or not the distortion created is audible to the listener.

In U.S. Pat. No. 5,323,469, Scholz proposed the addition of a substantially conical stabilizing element between the underside of the speaker cone and the tube on which the voice coil is wound. In the Scholz configuration, the center of the cone is attached to the upper end of the voice coil tube and the conical stabilizing element is attached to the voice coil tube about one third the length of that tube below the connection point of the tube with the speaker cone. Additionally, a conventional spider is connected between the speaker frame and the voice coil tube at the point where the conical stabilizing element attaches to the voice coil tube. While this may present some improvement in the distortion level, the forces on the cone and voice coil presented by the spider remains uneven and can still produce flexing of the speaker cone resulting in differing degrees of distortion through out the travel of the cone and voice coil.

SUMMARY OF THE INVENTION

Next two embodiments of the invention each present a speaker design and method that minimizes wobble of the voice coil bobbin during use based on the design of the surround and audio radiator.

Both embodiments include a flexible, ring shaped surround having, in cross-section, a pre-shaped, non-flat main body portion that extends radially through more than 180°, a flat outer ring extending outward from and attached to the main body portion of the surround, and a flat inner ring extending inward and attached to the main body portion at substantially 180° radially around the main body portion from the flat outer ring with a portion of the main body portion extending below the flat inner ring, forming a channel between the underside of the inner flat ring and the main body portion that extends below the flat inner ring.

The first of these embodiments includes an audio radiator having an outer edge, an inner edge with the inner edge defining a central opening through the radiator, a top surface and a bottom surface, with the outer edge defined by a short downward extending ring. In this embodiment, the downward extending ring of the radiator has an angle with the top surface of the radiator, with that angle complementing the included angle within the channel of the surround. Those angles in most instances will be substantially the same.

The second of these embodiments includes an audio radiator having an outer edge, an inner edge with the inner edge defining a central opening through the radiator, a top surface and a bottom surface, with the outer edge having a blunt end.

In each of those embodiments an outer most portion of the radiator of the radiator fits within the channel of the surround with the top of the outer portion of the radiator abutting the under side of the flat inner ring of the surround and the outer edge of the radiator abutting the portion of the main body portion of the surround that extends below the flat inner ring to positively center the surround and the radiator, one with the other. In the first of these embodiments, the downward extending ring of the radiator is angled to seat fully with the channel of the surround, whereas in the second of these embodiments the blunt end of the outer edge of the radiator extends substantially all the way into the channel of the surround. Then, in both designs, the outer portion of the radiator is glued within the channel of the surround.

Then in both of these embodiments a voice coil bobbin is mounted within the central opening of the radiator and attached to the inner edge defined by the central opening through the radiator, wherein a longitudinal centerline of the voice coil bobbin is coincident with a longitudinal centerline of the radiator, and the surround since the radiator is centered with respect to the surround.

Further, in both of these embodiments the speaker also includes a basket and magnet assembly. The basket has a bottom, and upward extending sides surrounding the bottom with the sides having an upper rim forming a mouth of the basket. The magnet assembly is mounted centrally to the bottom of the basket with a longitudinal centerline of the magnet assembly coincident with a longitudinal centerline of the basket. To complete the assembly of the speaker, the free end of the voice coil bobbin is inserted loosely within the magnet assembly and said flat outer ring of the surround is attached to the upper rim of the basket by so doing causing the longitudinal centerlines of said surround, radiator and voice coil bobbin to each be coincident with the longitudinal centerlines of the magnet assembly and basket. Thus with each of the centerlines of the components being positively aligned, one with the other, in operation, the wobble of the voice coil bobbin will be minimized or eliminated.

DETAILED DESCRIPTION OF THE PRESENT INVENTION

The flexing of the cone, causing the cone to change shape, in different positions as the cone is driven is related directly to the composition of the cone material, with the dynamic characteristics of the cone material responsible for the flexing which can only be overcome by the selection of a different material for the cone. However, if the flexing of the cone is caused by the geometry of the overall speaker design, the flexing of the cone can be overcome by configuring the cone, flexible surround and resilient spider of the speaker such that the resultant force(s) that cause the unwanted flexing of the cone are cancelled at points on the cone where the spider and/or the surround attach to the cone (i.e., the forces are balanced before they cause flexure of the cone) for all positions through which the cone is driven.

In speaker design, when the voice coil is at rest the shape of the cone is considered the reference shape that is determined by the static forces and weight of the various components of the speaker, including the surround and spider. To minimize distortion of the cone and wobble of the voice coil, the at rest shape is the desired shape regardless of the position of the cone. However, conventional speakers do not balance the forces for all positions that the cone goes through as it travels. Not only does the flexing of the cone and wobble of the voice coil cause distortion in the sound reproduction of the speaker, it will, in time, cause failure of the cone as a result of the life cycle of the cone material from the varying stresses.

Figure 1A:
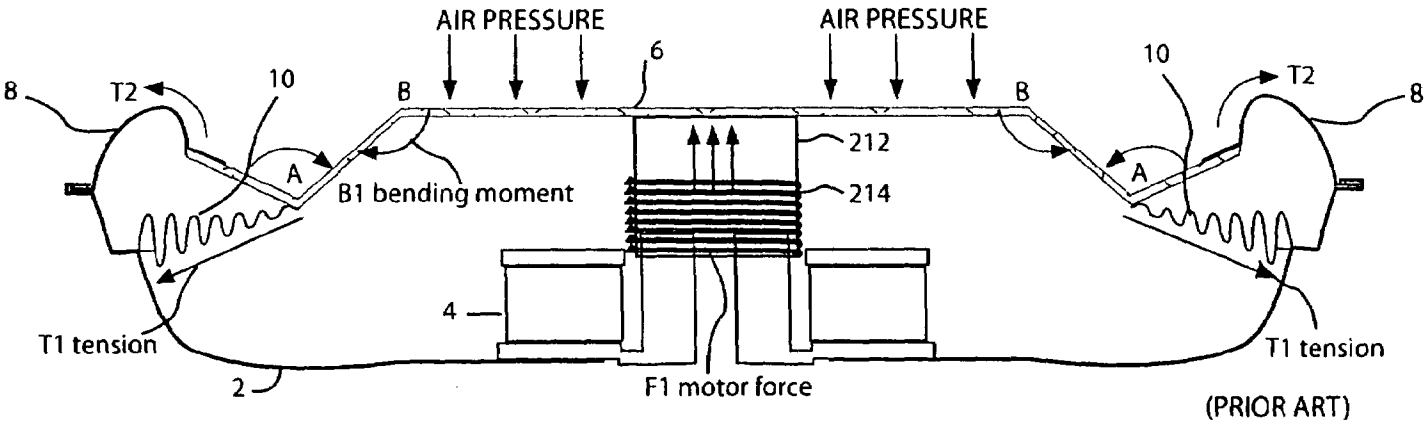
FIGS. 1*a*–1*c* are each a profile slice of the center of a typical prior art speaker with the cone in either the maximum extended, the rest or the maximum retracted position, respectively.
Figure 1B:
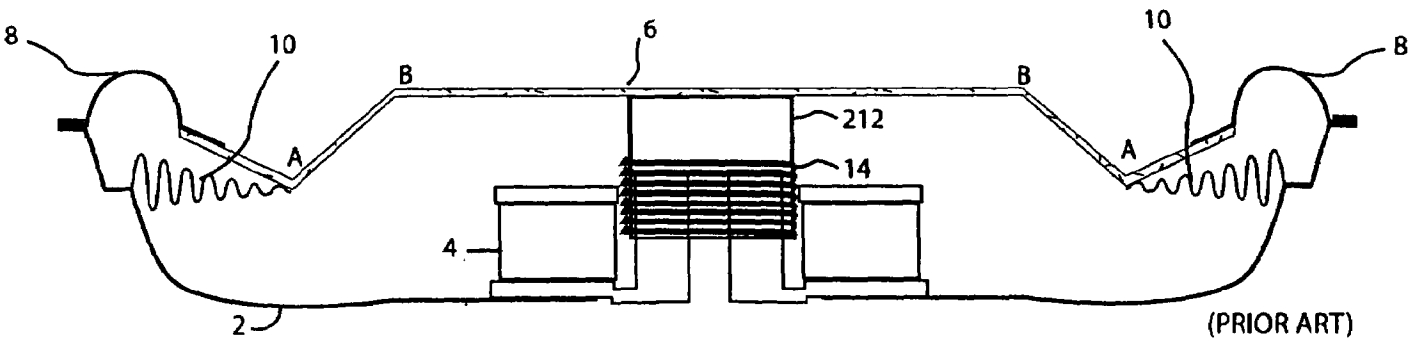
Figure 1C:
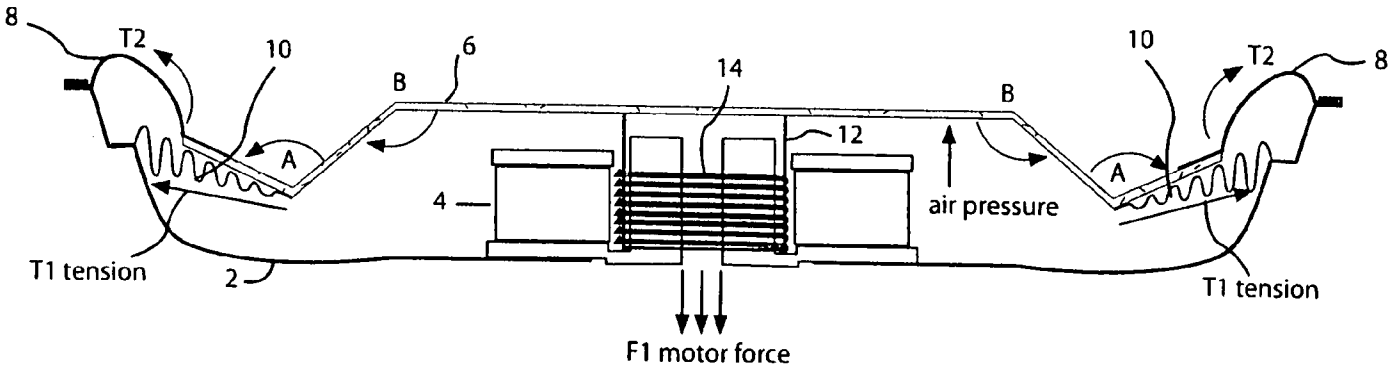
(PRIOR ART) FIG. 1C

FIGS. 1*a*–1*c* are each a profile slice of the center of a typical prior art speaker (shown here as a low profile speaker) with the cone in the maximum extended, the rest and the maximum retracted position, respectively. In each of these figures the speaker includes basket 2, magnet assembly 4, cone 6, surround 8, spider 10, voice coil tube 12 and voice coil 14. In FIG. 1*b* the speaker is unenergized with the rest position of the cone 6 and voice coil 14 being determined by the weight and static elasticity of cone 6, surround 8, spider 10 and voice coil tube 12 since no electrical sign is applied to voice coil 14.

When cone 6 is in any position other than the at rest position of FIG. 1*b*, the forces presented by surround 8 and spider 10 and the resilience, or lack there of, of cone 6 come into play to balance out the vertical motor force F1. As can be seen from FIGS. 1*a* and 1*b*, the tensile forces presented by spider 10 (T1) and surround 8 (T2) are not parallel to motor force F1, therefore there is both vertical and horizontal components of each of those forces with only the vertical components balancing motor force F1.

In FIG. 1*a*, for the speaker design of the example shown there, when cone 6 is at the maximum outward displacement, the tensile force T1 of the spider has a downward vertical component and an outward horizontal component with the horizontal component being substantially greater than the vertical component. Additionally, the horizontal component of T1 on one side of the speaker is balance by the horizontal component of T1 on the other side of the speaker. Thus, since T1 is not parallel to the segment of cone 6 between points A and B a bending moment will be created at point B. Since the horizontal component of T1 is greatest, the bending moment B1 at point B of cone 6 increases the included angle at point B. Similarly, the tensile force T2 of surround 10 presents an upward vertical component and an outward horizontal component with T2 not being parallel to the segment of cone 6 between point A and the point of attachment of surround 8 with the vertical component being much greater than the horizontal component. The vertical force component of T2 being greater causes a bending moment at point A of cone 6 that reduces the included angle at point A. The extent to which the angles at points A and B change is also dependent on the tensile strength and flexibility of cone 6. The changing of these angles can also cause distortion of the surface of cone 6 at points other than A and B which cause voice coil tube 12 to be displaced relative to the central axis of basket 2 as described above.

In FIG. 1*c*, for the speaker design of the example shown there, when cone 6 is at the maximum inward displacement the tensile force T1 of the spider has an upward vertical component and an outward horizontal component with the horizontal component being substantially greater than the vertical component. Since the horizontal component of T1 is greatest, the bending moment at point B of cone 6 increases the included angle at point B. Similarly, the tensile force T2 of surround 10 presents an upward vertical component and an outward horizontal component. Whether or not the included angle at point A changes depends on whether force T2 is parallel to the segment of cone 6 between point A and the point of attachment of surround 8. If T2 is parallel to that segment, then the included angle at point A does not change. If T2 is not parallel to that segment of cone 6, the change in the included angle at point A depends on which of the horizontal and vertical components of force T2 is greatest. If the horizontal component of is greatest, the included angle at point A will increase; alternatively, if the vertical component is greatest, the included angle at point A will decrease. Any changes to the shape of cone 6 in the inward most position has a different effect on the distortion of cone 6 and thus on the position of voice coil tube 12 relative to the central axis of the speaker basket 2. This variation of the position of voice coil tube 12 for different positions of cone 6 is defined as the wobble of voice coil tube 12.

Figure 2A:
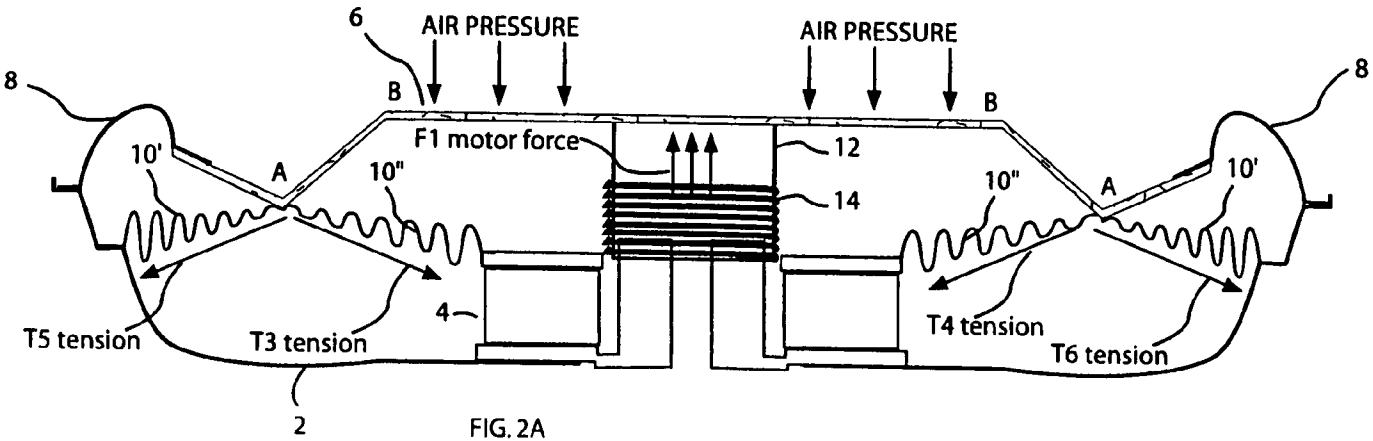
FIGS. 2*a*–2*c* are each a profile slice of the center of a speaker of the basic structure shown in FIGS. 1*a*–1*c* for one embodiment of the present invention.

The present invention provides an speaker design wherein the forces on the cone are balanced at all times throughout the travel of the cone. For the first embodiment of the present invention, the basic structure of the speaker of FIGS. 1*a*–1*c* is modified. FIG. 2*a* shows cone 6 in the maximum outward position and since the basic structure here is the same as FIGS. 1*a*–1*c*, the same reference numbers are used. The differences in FIGS. 2*a*–2*c* with respect to FIGS. 1*a*–1*c* is the inclusion of an outer spider 10' that is similar to spider 10 in FIGS. 1*a*–1*c*, and an inner spider 10" between point A and the top of magnet 4. It can be seen that both spider 10' and 10" apply a tensile force to point A of cone 6 on both sides of the center slice of the speaker which is the same for any center slice taken trough the speaker.

In this configuration, on the left side outer spider 10' applies force T5 on point A and inner spider 10" applies force T3 on point A. Similarly on the right side of the speaker, outer spider 10' applies force T6 on point A and inner spider 10" applies force T4 on point A. Each of forces T3, T4, T5 and T6 have both a vertical and a horizontal component with spiders 10' and 10" being selected to balance the horizontal component of force on point A on both sides of the speaker in these view and totally around the speaker. That is, the horizontal outward component of T5 is equal to the inner horizontal component of T6, and the horizontal components of T2 and T4 are similarly balanced. By balancing the horizontal forces at point A on both sides of the speaker where the forces are applied, the result is no, or a very small bending moment at point B all around the speaker, unlike the prior art where the horizontal forces are balanced from the opposite side of the speaker (i.e., 180° around the speaker) as shown in FIGS. 1*a*–1*c*. While spiders 10' and 10" are discussed as being separate, they could be implemented as a single spider with point A of the cone affixed to a corresponding point on the spider where the forces balance, with point A being affixed to the spider continuously all the way around cone 6.

Since the material of surround 8 is much more flexible than the material used for spiders, the horizontal forces applied to the outer edge of cone 6 is much smaller than the horizontal forces applied by the stiffer spider at point A. This results in a minimal, or zero bending moment at point B while there may still be a small bending moment at point A resulting from the surround since the horizontal component of the tensile force applied by the surround is balance by a force applied on the other side of the speaker cone. Thus, the possibility of distortion of cone 6 and the resulting sound being reproduced is very small and most likely not above the threshold of the human ear.

Figure 2B:
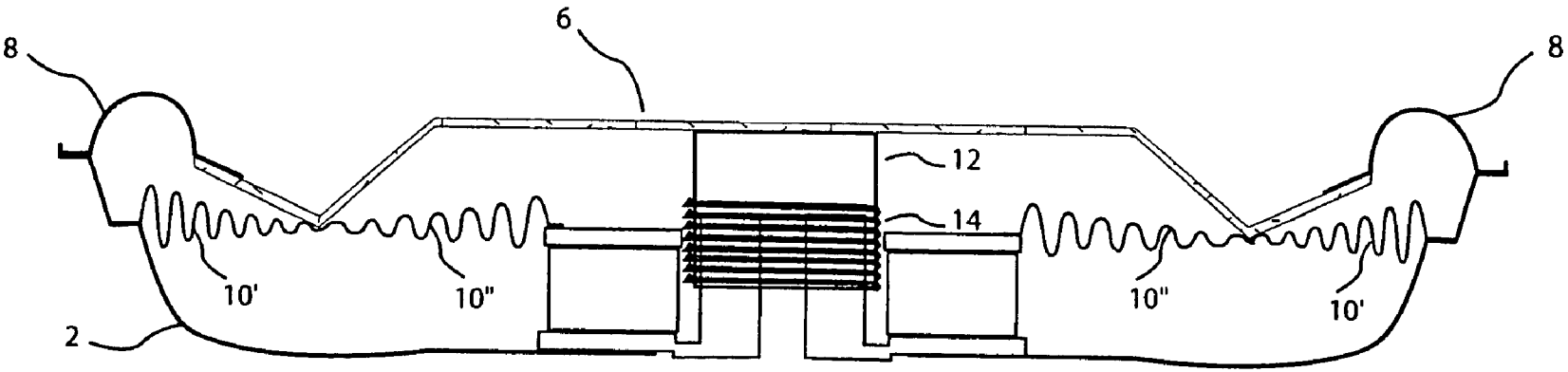
Figure 2C:
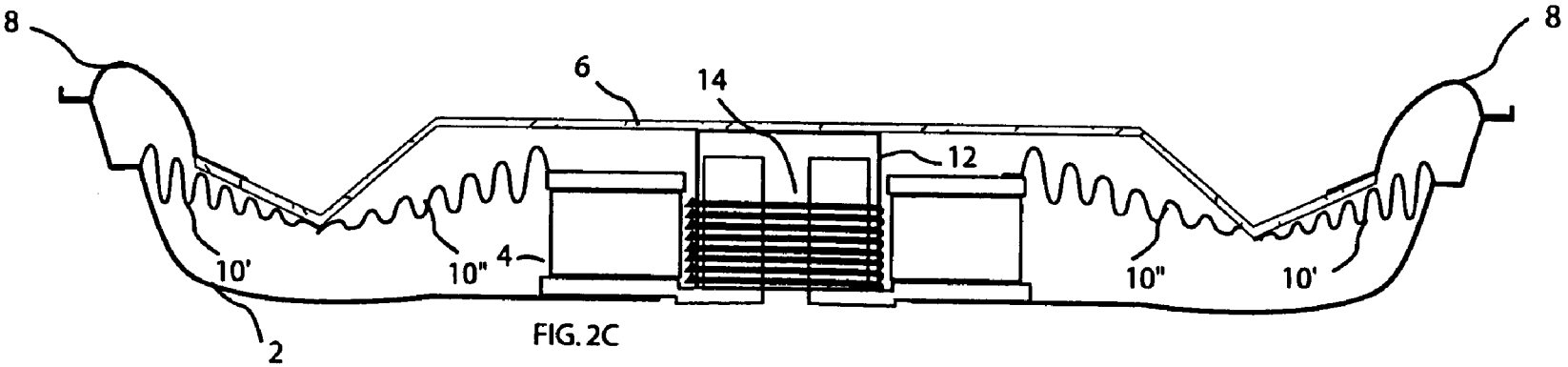

It can be seen from FIGS. 2*b* and 2*c*, that the present invention provides a speaker design wherein the forces on the cone are substantially balanced at all times throughout the travel of the cone. As is the case with respect to FIG. 1*b*, in the configuration of FIG. 2*b* everything is at rest with the position of cone 6 is determined by the weight of cone 6 and voice coil tube 12, and the flexibility of surround 8 and spiders 10' and 10".

Figure 3A:
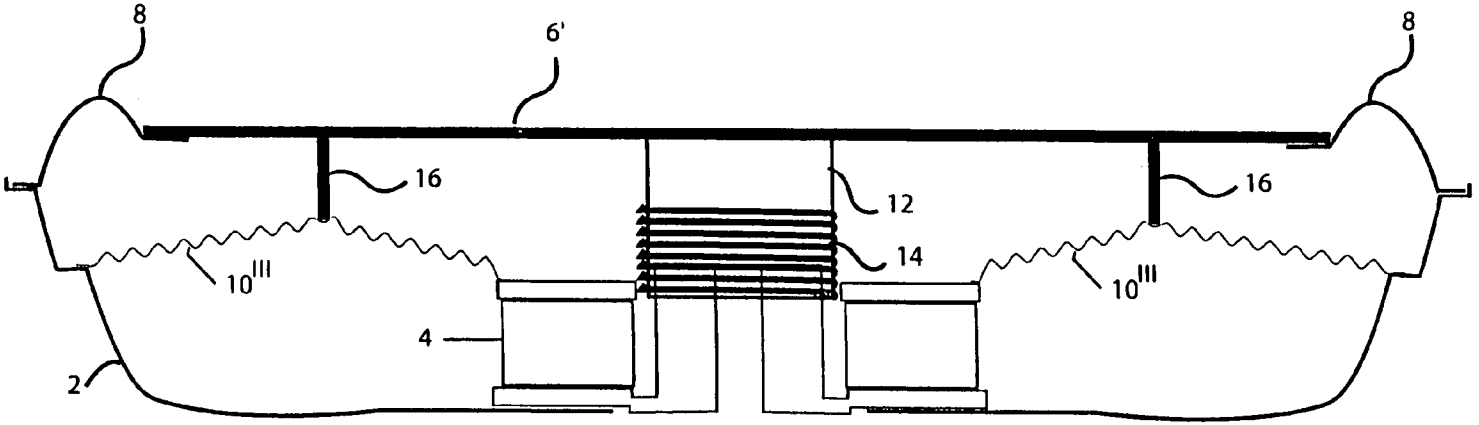
FIGS. 3*a*–3*c* are each a profile slice of the center of a speaker of the structure shown in FIGS. 2*a*–2*c* with the cone replaced with a flat baffle for a second embodiment of the present invention.
Figure 3B:
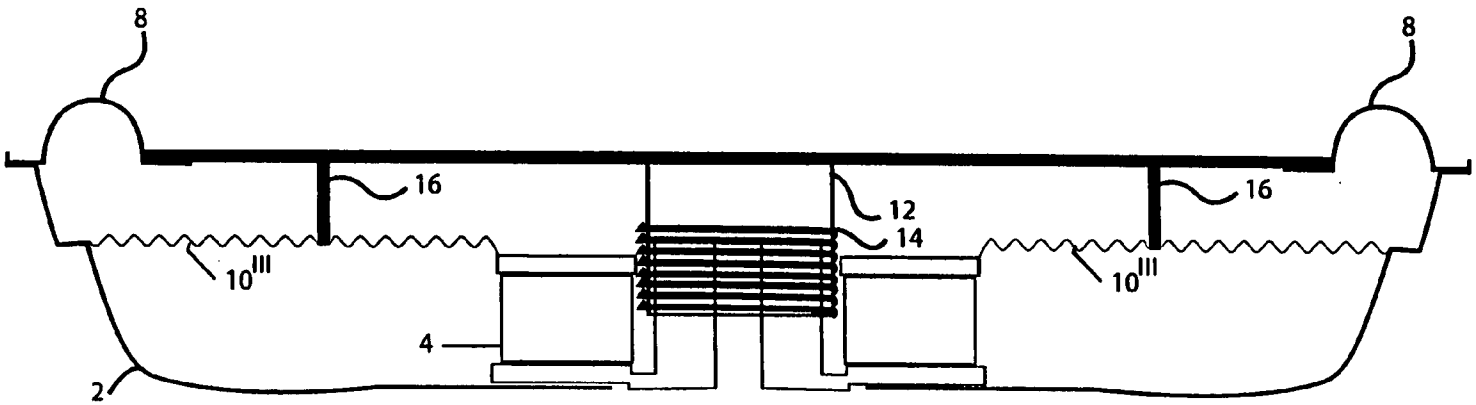
Figure 3C:
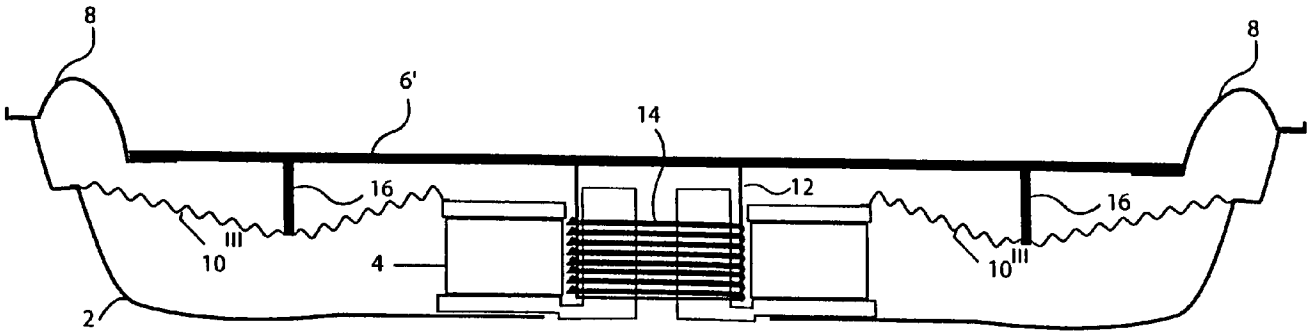

FIGS. 3*a*–3*c* show another shallow speaker design that is similar to that of FIGS. 2*a*–2*c* with cone 6 of FIGS. 2*a*–2*c* replaced with a flat cone or baffle 6' formed with a ring 16 extending from the bottom side of baffle 6' and having an internal diameter that is greater than the outside diameter of the largest components of magnet 4. Ring 16 can be attached to the underside of baffle 6' in a number of different ways, including, but not limited to, being molded with baffle 6' or fused or glued to baffle 6'. The lower extent of ring 16 then attaches to spider 10''' at a point where substantially equal tension will be applied to ring 16 by each of the two portions of spider 10''' (i.e., the portion between basket 2 and ring 16, and the portion between ring 16 and magnet 4). Of course, here, as in the previously described embodiment, spider 10''' can be either one continuous spider or two individual spiders, one to each side of ring 16, and the bottom of ring 16 is equivalent to point A in FIGS. 2*a*–2*c*.

A passive radiator is like the speaker of FIGS. 3*a*–3*c* without the magnet and voice coil assembly, thus it can be seen that the same suspension technique lends itself to use in a passive radiator. While a passive radiator does not have a voice coil tube wobble problem, the entire baffle may wobble if the tension on ring 16 is unequal throughout the range of travel that it undergoes. That wobble could result in discernable distortion of the sound wave produced due to an uneven flexing of the baffle, and the side to side component of that wobble results in some energy being lost that could otherwise be delivered in the sound wave produced by the baffle.

Figure 4A:
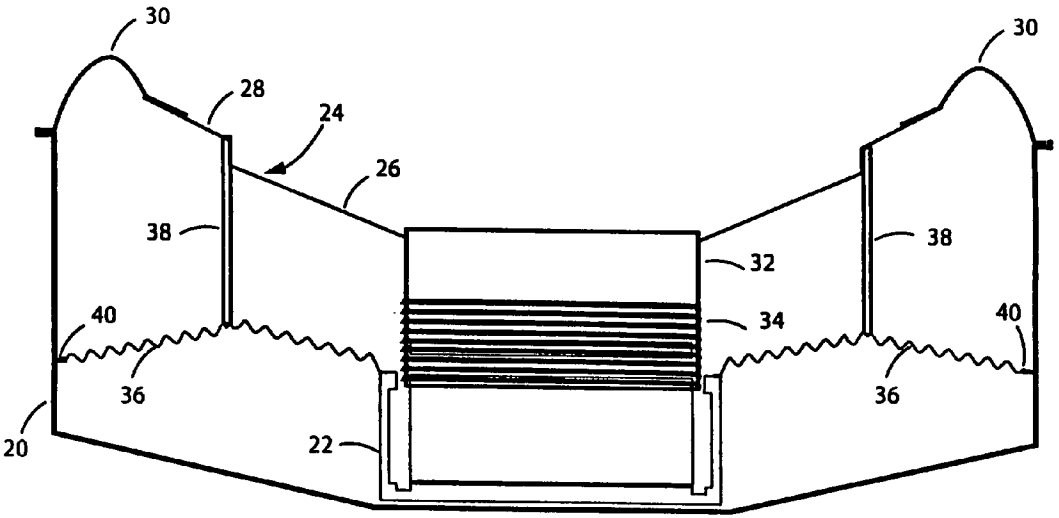
FIGS. 4*a*–4*c* are each a profile slice of the center of a speaker with a concave cone for a third embodiment of the present invention.
Figure 4B:
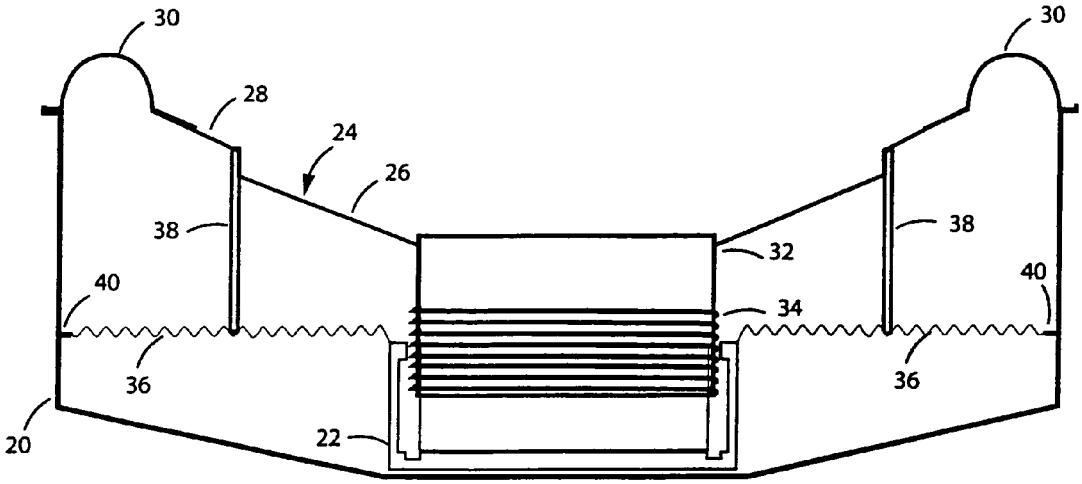
Figure 4C:
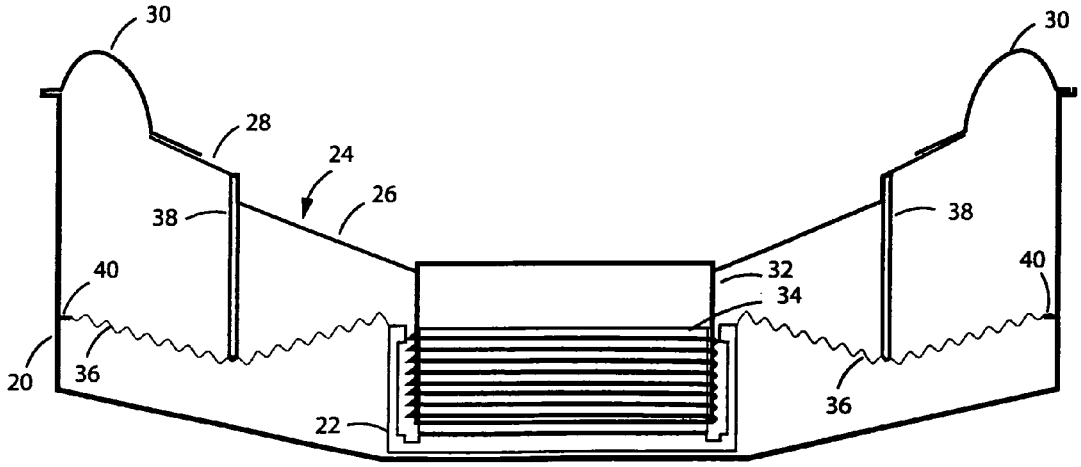

FIGS. 4*a*–*c* illustrate the three positions discussed above of a speaker with a concave cone of a third embodiment of the present invention. This speaker includes a deep basket 20 with a magnet assembly 22 in the center bottom portion of the basket, a concave cone 24 affixed at the center to voice coil tube 32, with voice coil 34 on the lower end thereof.

Tube 32 surrounds the central portion of magnet assembly 22. Cone 24 is shown here having a center conical section 26 with the outer rim affixed to downwardly extending ring 38 and an outer conical section 28 flaring out from the top of ring 38 (it should be noted that cone 24 could have a simple conical shape with ring 38 attached to the bottom of cone 24). The outer rim of cone section 28 is attached to the mouth of basket 20 via surround 30. Within the lower portion of basket 20 there is shown an attachment point 40 that encircles and extends a short distance into the inside of the basket. From FIG. 4*b* where the speaker is unenergized and cone 24 is in the static position, it can be seen that attachment point 40 is opposite the upper outer extent of magnet assembly 22 and the bottom edge of ring 38 which is approximately centered between attachment point 40 and the upper extent of magnet assembly 22. Additionally, there is a spider 36 (either a single piece or two pieces as discussed above) having the outer edge attached to attachment point 40 and the inner edge attached to the upper extent of magnet assembly 22. Approximately in the center of spider 36, the bottom edge of ring 38 is attached. From FIGS. 4*a*–4*c* it can be seen that forces on the end of ring 38 are balanced at each point of attachment to spider 36 as discussed previously for other embodiments of the present invention; not the opposite side of the speaker as in the prior art.

Figure 5A:
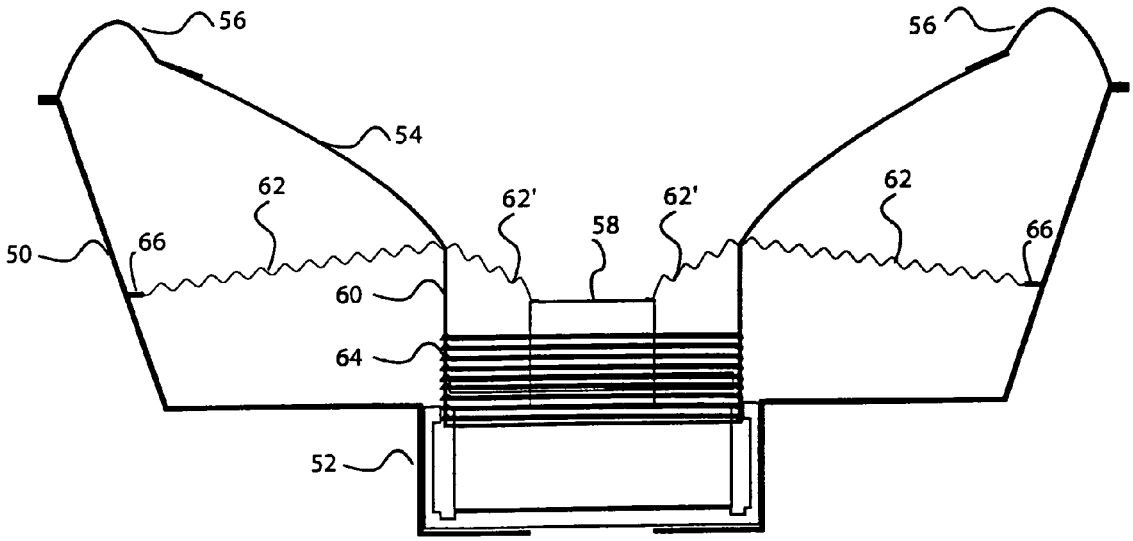
FIGS. 5*a*–5*c* are each a profile slice of the center of a speaker with a concave cone having an open center hole with a center pillar of the magnet extending upward through that hole for a fourth embodiment of the present invention.
Figure 5B:
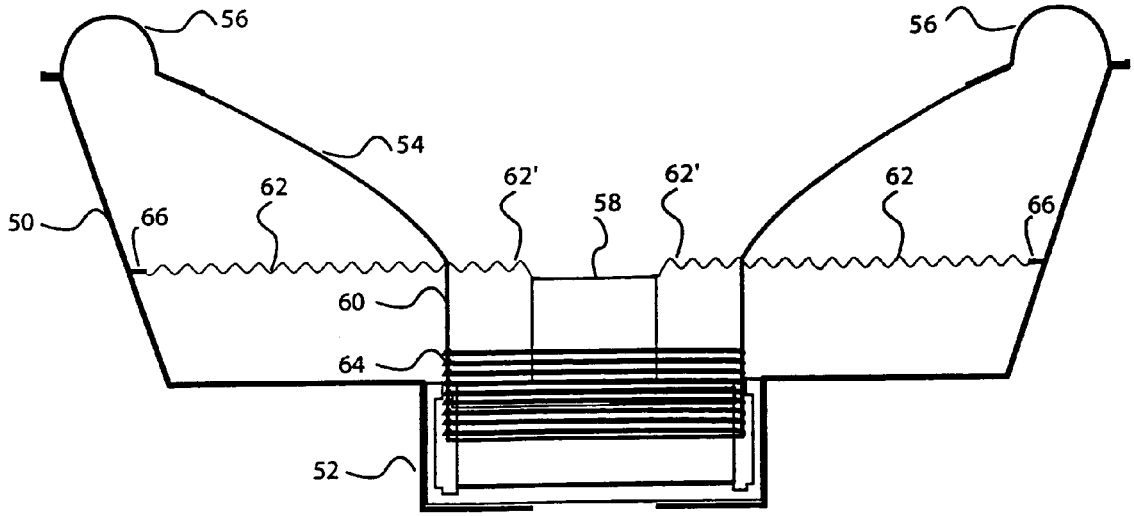
Figure 5C:
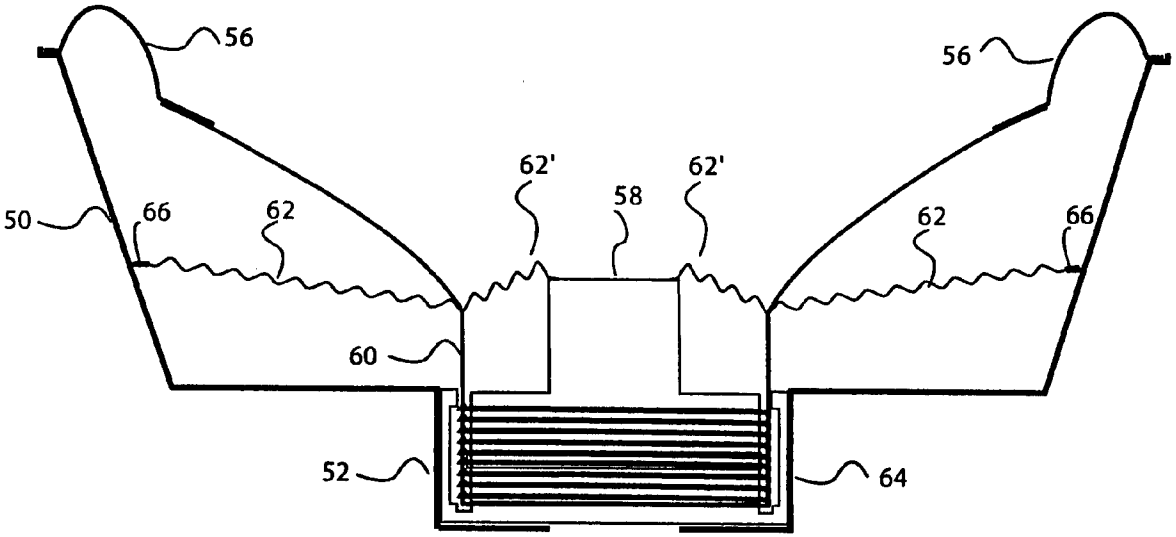

FIGS. 5*a*–5*c* are each a profile slice of the center of another design of a deep basket speaker. This speaker includes a deep basket 50 with a magnet assembly 52 in the center bottom portion of the basket, a concave cone 54 affixed at the center to voice coil tube 60, with voice coil 64 on the lower end thereof. Tube 60 surrounds magnet assembly 52 with the magnet assembly having an upper extending central pillar 58. The outer rim of cone 54 is connected to the mouth of basket 50 via surround 56, and the center of cone 54 is attached to the upper edge of voice coil tube 60. Within the lower portion of basket 50 there is shown an attachment point 66 that encircles and extends a short distance into the inside of the basket. From FIG. 5*b* where the speaker is unenergized and cone 54 is in the static position, it can be seen that attachment point 66 is opposite both the junction of cone 54 and voice coil tube 60 as well as the top of pillar 58 of magnet assembly 52. There is also a spider 62/62' strung between attachment point 66 and the top of pillar 58 through the junction of cone 54 and tube 60. Spider 62/62' can be either a single spider or two spiders as discussed above. From FIGS. 5*a*–5*c* it can be seen that forces on the junction of cone 54 and the top of tube 60 are balanced at each point of attachment to the spider by spider portions 62 and 62' as discussed previously for other embodiments of the present invention; not the opposite side of the speaker as in the prior art. This embodiment is presented to illustrate that both portions of the spider of the present invention have to be beneath the cone of the speaker and all portions of the spider do not have to be outside the voice coil tube.

It is to be understood that in each of the embodiments illustrated in the FIGS. and discussed herein the speaker has been shown in cross section as is typically done for ease of visualizing the speaker constructions. Additionally it is to be understood that spider, and spider portions, totally and continuously surround the central portion of the speaker or passive radiator.

From the variety of speaker configurations disclosed above that incorporate the balanced spider of the present invention, it is clear that the balanced spider can be incorporated into virtually all speaker designs. Thus, the present invention, simply stated, is the balancing of the forces at each point of attachment with the spider without one side being balanced from the opposite side of the speaker as in the prior art. Thus, the invention is not to be interpreted as being limited to only the speaker designs illustrated here, but to include any speaker design.

Since the anti-wobble embodiment of the invention being discussed in relation to FIGS. 6*a*–12*b* turns on the design of the cone and surround, for simplicity only a partial assembly of a speaker is addressed to illustrate this embodiment. It is to be understood that the un-shown speaker components will be present in the complete assembly. It should also be understood that the embodiment of the invention discussed with the aid of these figures could also be combined with one or more of the previously discussed embodiments of the anti-wobble feature.

Figure 6:
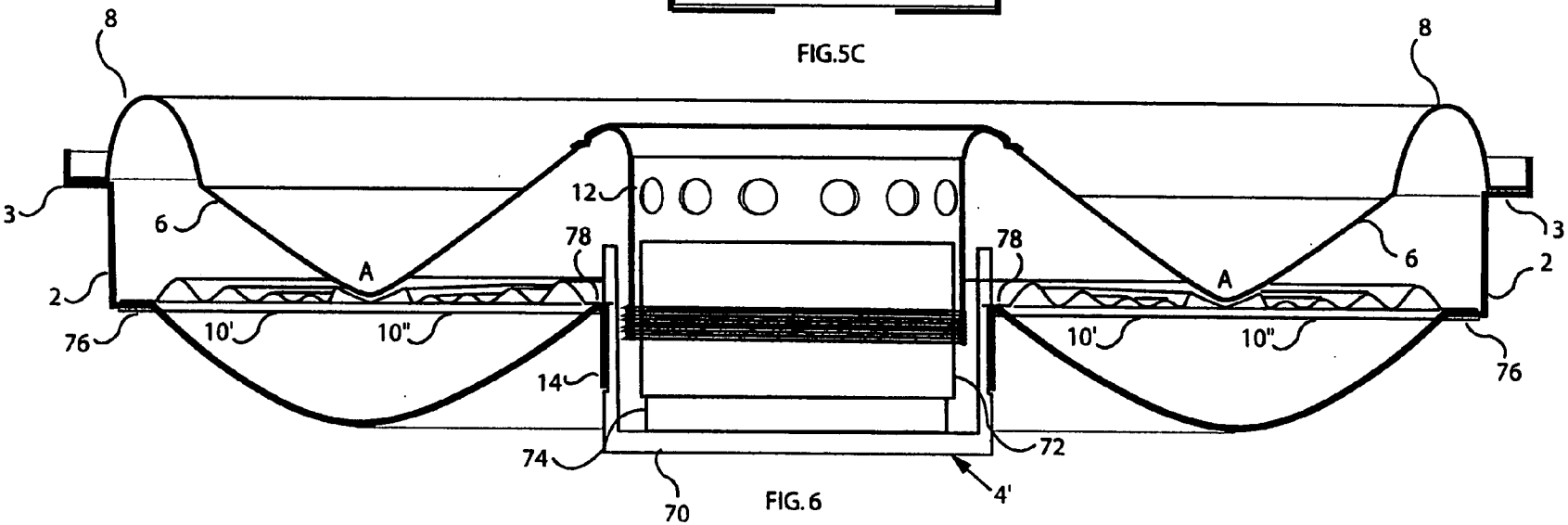
FIG. 6 is a profile slice of another embodiment of the invention of a low profile speaker with a concave cone having a center hole coupled to the top of the voice coil bobbin with a lowest point of the cone intermediate the center hole and outer rim coupled to the center of a spider that extends between an inner portion of the speaker frame and an outer most portion of the magnet assembly centered within the speaker frame.
Figure 6A:
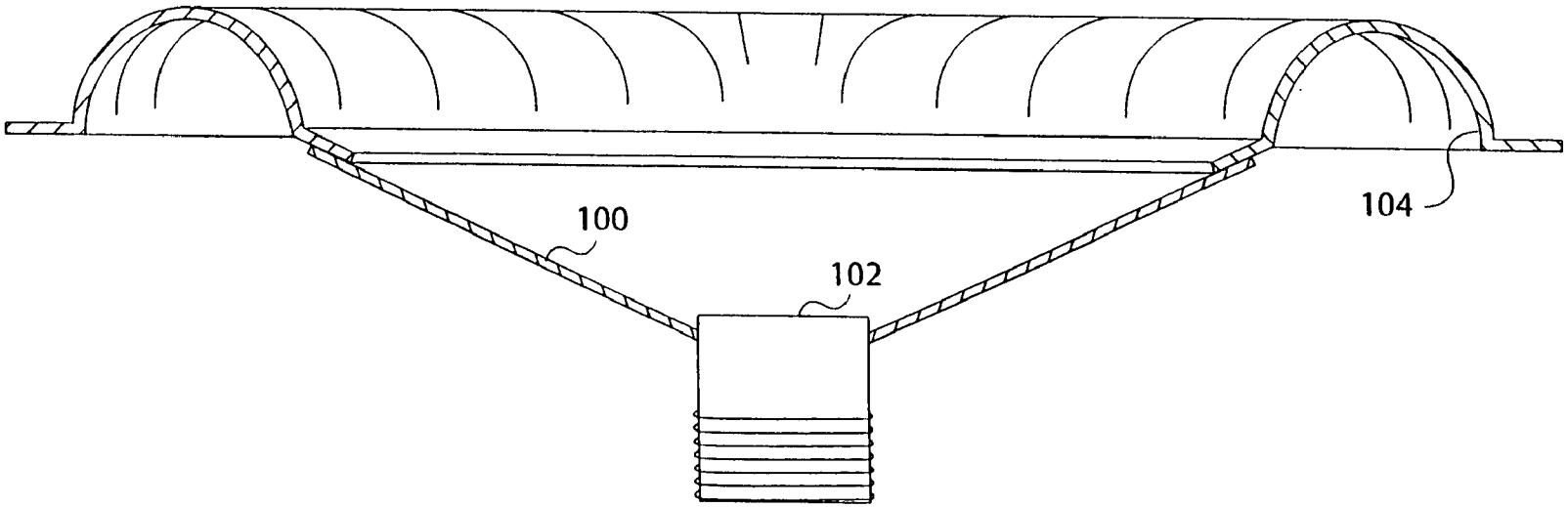
FIG.-6a (PRIOR ART)
FIG. 6*a* is a cross-section of the assembly of a surround, cone and voice coil bobbin of a convention speaker.
Figure 6B:
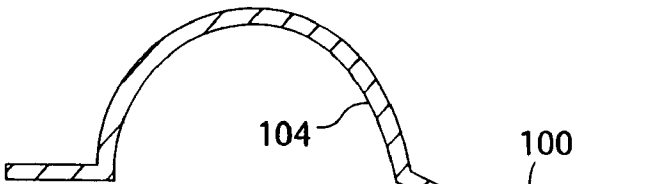
FIG.-6b (PRIOR ART)
FIG. 6*b* is a close up of a slice of the assembly of a conventional surround and cone of a conventional speaker as in FIG. 6*a;*

FIG. 6*a* is a cross-section of the assembly of a surround 104, cone 100 and voice coil bobbin 102 of a convention speaker, and FIG. 6*b* is a close up of a slice of the point of attachment of a conventional surround and cone of the conventional speaker as in FIG. 6*a*. Cone 100 has a conical shape with the center peak removed defining a central hole therethrough. When installed in a speaker basket, cone 100 is inverted as shown in FIG. 6*a* with voice coil bobbin 102 fit and glued within the central hole of cone 100. The outer edge of cone 100 is simply an extension of the conical shape having a blunt end. Surround 104 also has a typical surround half round doughnut shape with a first flat ring extending outward from the doughnut shape to define an outer edge of surround 104. Similarly, the doughnut shaped surround has a second flat ring extending toward the center with the inner most edge of the second flat ring defining the perimeter of a large center hole encircled by the surround. The first flat ring is disposed to be attached to the outer rim of a speaker basket (not shown), and the second flat ring is disposed to be attached to the outer edge portion of cone 100.

As can be better seen in FIG. 6*b*, the flat underside of the inner second flat ring of surround 104 is glued to the flat top surface of the outer edge portion of cone 100. Thus in the typical speaker the centering of the outer edge of the cone with the inner second flat ring of the surround for gluing is merely "eyeballed" since there is no centering features incorporated into either the cone or the surround. Thus, more times than not, the cone and surround in typical speakers are not centered one with the other, rather one is offset from the other, i.e., the overlap of the second flat ring of the surround with the outer edge portion of the cone is greater on one side than on the other.

That offset is most critical in speakers with long travel lengths for the voice coil bobbin, however the offset can create problems in speakers with shorter travel lengths, depending on the amount of offset. Offset resulting from the "eyeball" centering during assembly of the surround and the cone translates to an offset of the voice coil bobbin in the magnet assembly. This is the case since the centers of the magnet assembly and the surround are defined by there positive placement and attachment provided by the basket, whereas the center of the voice coil bobbin is defined by the center of the cone. Thus, if the centers of the surround and the cone are offset one from the other there is a high probability that the voice coil will rub against the inner magnet walls as the voice coil bobbin travels in the confined space of the magnet assembly since the voice coil bobbin and the magnet assembly are not centered one with the other.

Figure 7B:
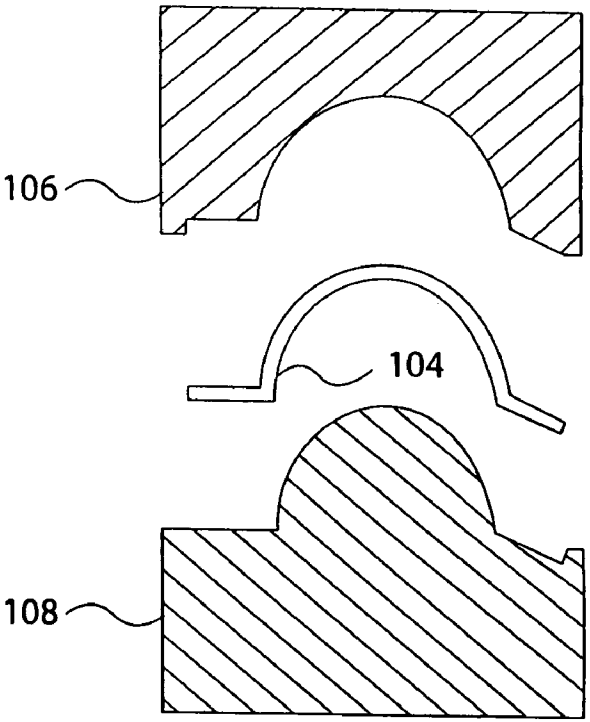
FIG.-7b (PRIOR ART)
FIG. 7*b* is a slice of an exploded view of a two piece mold for forming a conventional surround with a surround shown intermediate the two pieces of the mold.
Figure 7A:
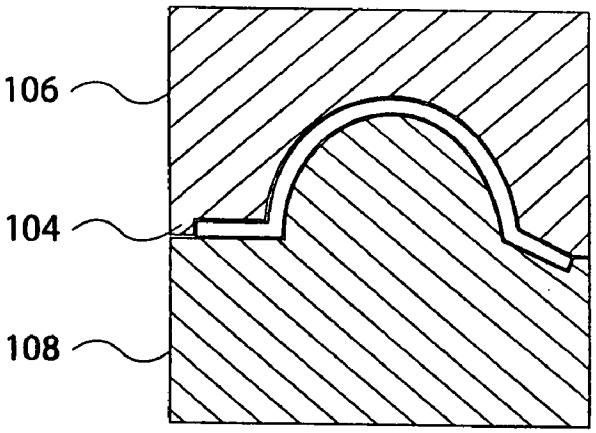
FIG.-7a (PRIOR ART)
FIG. 7*a* is a slice of a closed two piece mold for forming a conventional surround with a surround between the two mold pieces.

FIG. 7*a* is a slice of a closed two piece mold for forming a conventional foam surround 104 between the two mold pieces 106 and 108. FIG. 7*b* is a slice of an exploded view of a two piece mold with the conventional foam surround formed thereby shown intermediate the two pieces of the mold.

Figure 8A:
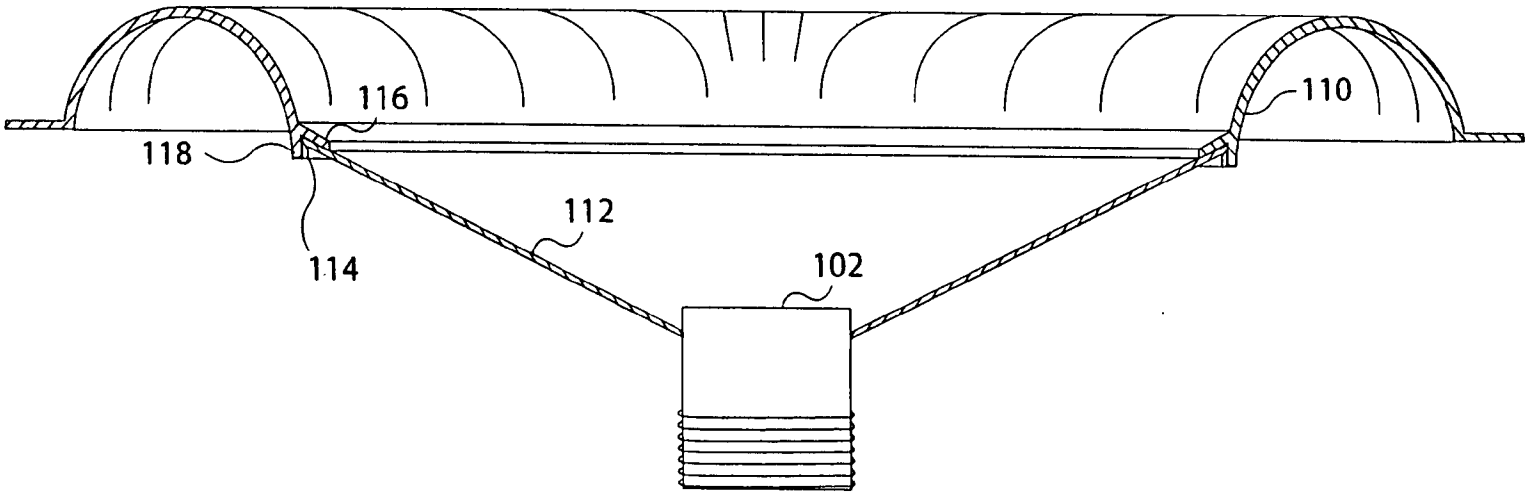
FIG. 8*a* is a cross-section of the assembly of a surround and cone of the present invention with a voice coil bobbin.
Figure 8B:
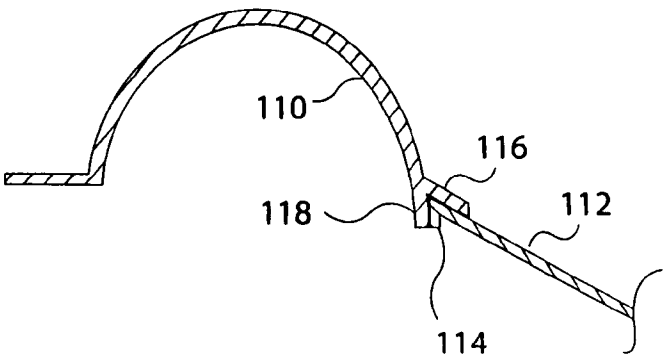
FIG. 8*b* is a close up of a slice of the assembly of the surround and cone of a of the embodiment of FIG. 8*a;*
Figure 8C:
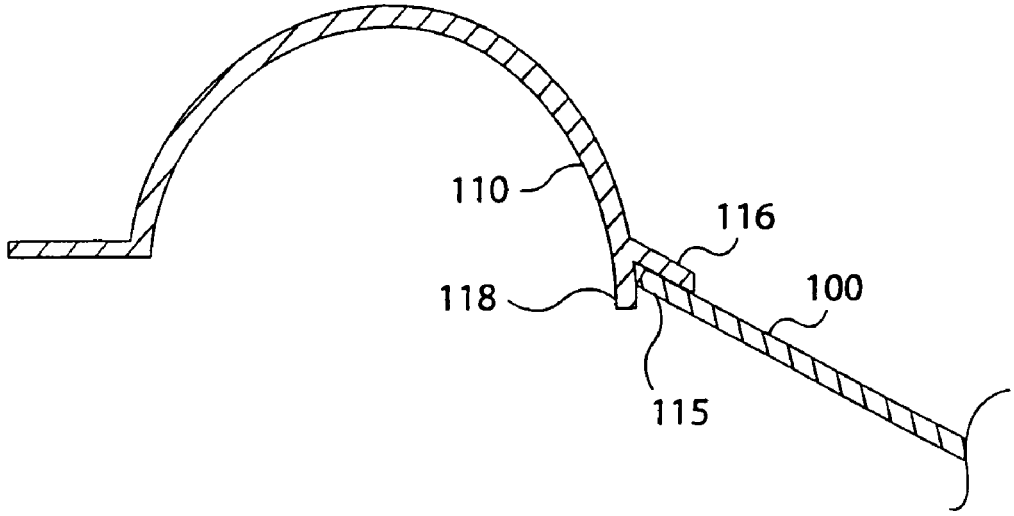
FIG. 8*c* is a close up of a slice of the assembly of the surround and cone of a of a variation of the embodiment of FIGS. 8*a* and 8*b;*

FIGS. 8*a*, 8*b* and 8*c*, in views similar to those of FIGS. 6*a* and 6*b*, illustrate the assembly of surround 110 and cone 112 of the present invention to insure positive centering Of one with respect to the other, and that assembly then having the voice coil bobbin attached in the central opening defined by cone 112. From FIGS. 8*a* and 8*b* it can be seen that cone 112 has been formed by shaping the outer edge with a short downward extending ring 114 with ring 114 extending downward at a selected angle. Further, surround 110 is formed with semi-circular body extending through more than 180° (e.g., 190°) with flat inner ring 116 formed to extend from the semi-circular body at substantially 180° from the flat outer ring with that positional relationship between the inner and outer flat rings being as in prior art surrounds. Surround 110 formed in this manner thus defines a "V" shaped channel on the underside of the inner portion of surround 110 where inner flat ring 116 extends away from the semi-circular body in extension 118 of the body beyond the point where inner flat ring 116 extends away from the main body of surround 110. The selected angle at which ring 114 of cone 112 extends downward is selected to complement the angle formed in the "V" shaped channel of surround 110.

When assembling cone 112 with surround 110, the "V" shaped channel on the under side of surround 110 is sized and shaped to receive the outer edge of cone 112 and downward extending ring 114 therein with the top side of the outer edge of cone 112 glued against the under side of inner flat ring 116 and the outer most surface of downward extending ring 114 abutting and glued to surround body extension 118. Since the "V" shaped groove of surround 110 is sized and shaped to match the size and shape of the outer edge of cone 112, the placement and gluing of surround 110 to cone 112 results in a positive alignment and thus centering of cone 112 with surround 110. This then results in the centering of voice coil bobbin 102 with the other speaker components, particularly the magnet assembly, which in turn results in rub-free travel of the voice coil between the walls of the magnet thus eliminating wobble of the voice coil bobbin during travel.

FIG. 8*c*, shows in close-up, a second embodiment of the present invention that utilizes surround 110 as described in relation to FIGS. 8*a* and 8*b* together with a conventional cone 100 having a blunt outer edge 115. As with the previous embodiment the diameter of the "V" shaped groove on the underside of surround 110 is substantially the same diameter as the outer blunt edge of cone 100 to provide positive centering of surround 110 and cone 100. In this embodiment, the top outer portion of cone 100 is glued to the underside of inner flat ring 116 of surround 110, and the blunt outer edge of cone 100 is glued to extension 118 of surround 110. The differences between the two embodiments of the present invention illustrated and discussed here requires slightly more care in the assembly of the surround and cone of the embodiment of FIG. 8*c* that in the embodiment of FIG. 8*b* since that of FIG. 8*b* provides more of a matched interface between the surround and the cone. Both embodiments result in positive alignment of the centers of the surround and the cone.

Figure 8D:
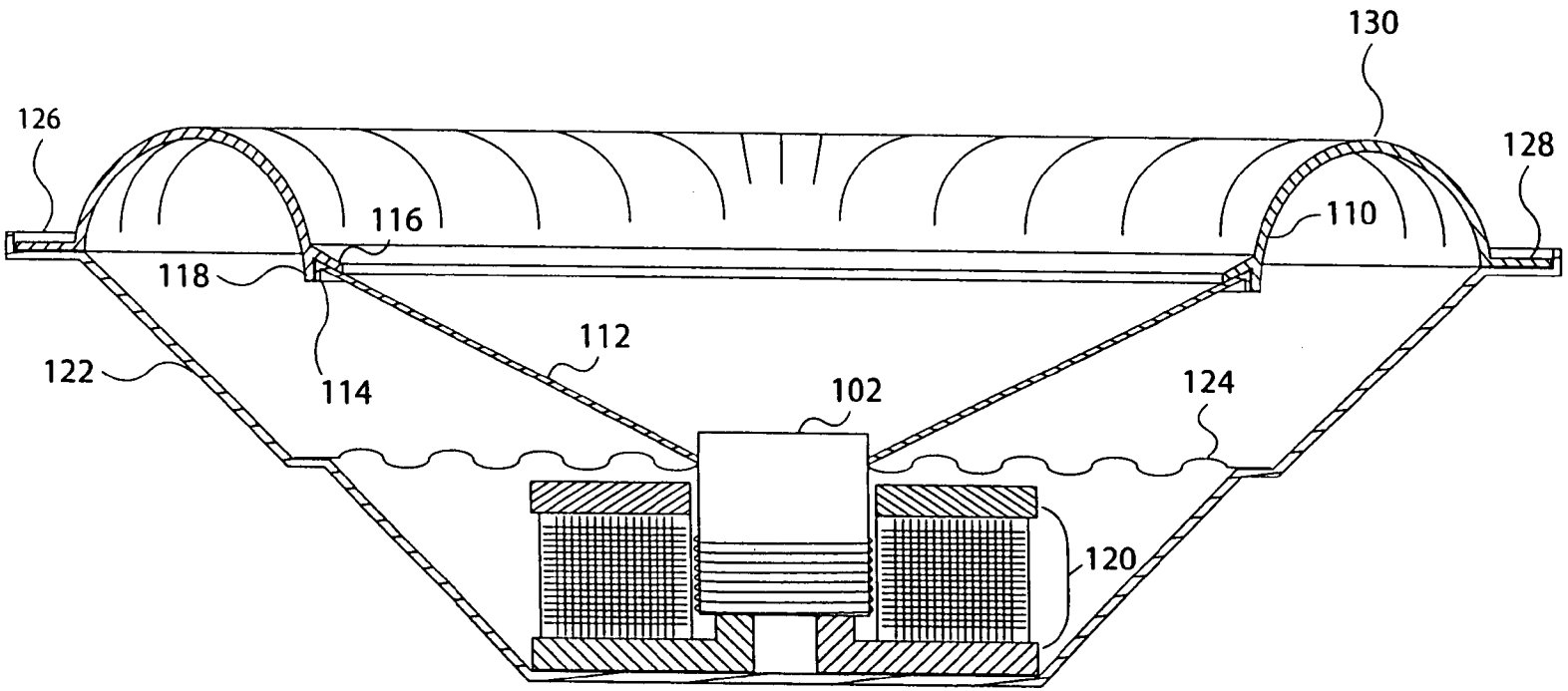
FIG. 8*d* is a cross-section of a speaker assembly that includes one of the alternative embodiments of present invention shown in FIGS. 8*b* and 8*c;*

FIG. 8*d* is a cross-section of a speaker assembly that includes the second of the alternative embodiments of present invention shown in FIGS. 8*a*, 8*b* and 8*c*. In this view the speaker is in basket 122 with magnet assembly 120 mounted centrally in the bottom of the basket. Voice coil bobbin 102 is at rest in the gap of magnet assembly 120 being supported in the center hole of cone 112 to which it is glued and spider 124 connected between bobbin 102 and the interior of basket 122 below the upper rim 126 of the basket. Cone 112 and surround 110 are connected together was described above in relation to FIGS. 8*a* and 8*b*. In this view it can be seen how surround 110 is positively centered with respect to basket 122, namely outer flat ring 128 is attached to the outer rim of basket 122 with the free edge of outer flat ring 128 in direct contact with upper rim 129 completely around the mouth of basket 122. Thus, with surround 110 and magnet assembly 120 positively centered with respect to basket 122, and cone 112 centered with respect to surround 110 by means of the present invention and bobbin 102 attached to the center hole of cone 112, it can be seen that surround 110, magnet assembly 120, cone 112 and bobbin 102 all share the centerline, CL of basket 122. Therefore wobble of bobbin 102 when traveling will be minimized.

Figure 9B:
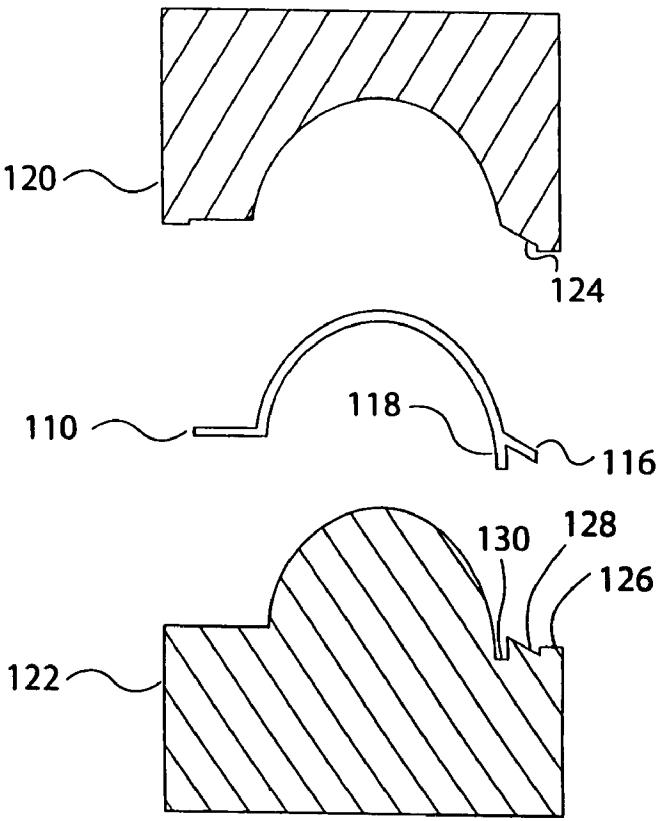
FIG. 9*b* is a slice of an exploded view of a two piece mold for forming a surround of FIGS. 8*a* and 8*b* with the surround shown intermediate the two pieces of the mold.
Figure 9A:
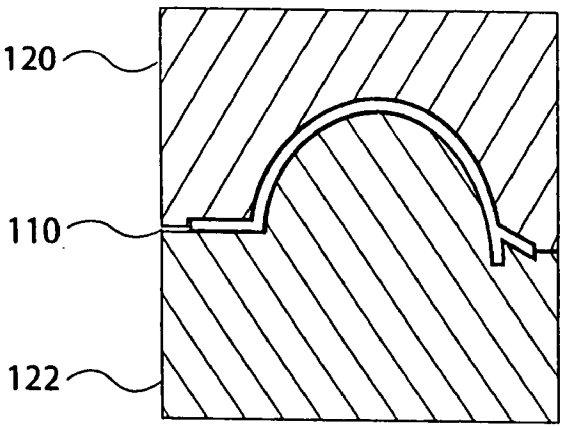
FIG. 9*a* is a slice of a closed two piece mold for forming a surround of FIGS. 8*a* and 8*b* with the surround between the two mold pieces.

FIG. 9*a* is a slice of a closed two piece mold for forming foam surround 110 of the present invention between the two mold pieces 120 and 122. FIG. 9*b* is a slice of an exploded view of a two piece mold for forming foam surround 110 of the present invention with surround 110 shown intermediate the two pieces of the mold. Thus it can be seen by comparing FIGS. 7*b* and 9*b*, the lower mold piece 122 for forming the foam surround 110 of the present invention includes a circular, square bottom groove 130 to produce body extension 118 with flat inner ring 116 being formed between flat faces 124 and 128, and end stop 126.

Figure 10A:
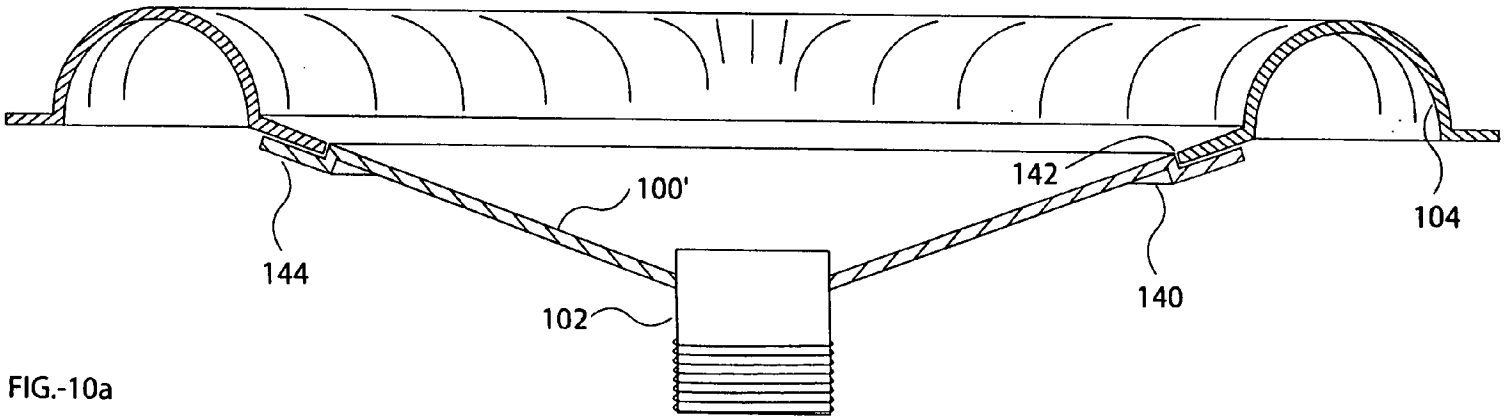
FIG. 10*a* is a cross-section of the assembly of a surround and cone of the present invention with a voice coil bobbin.
Figure 10B:
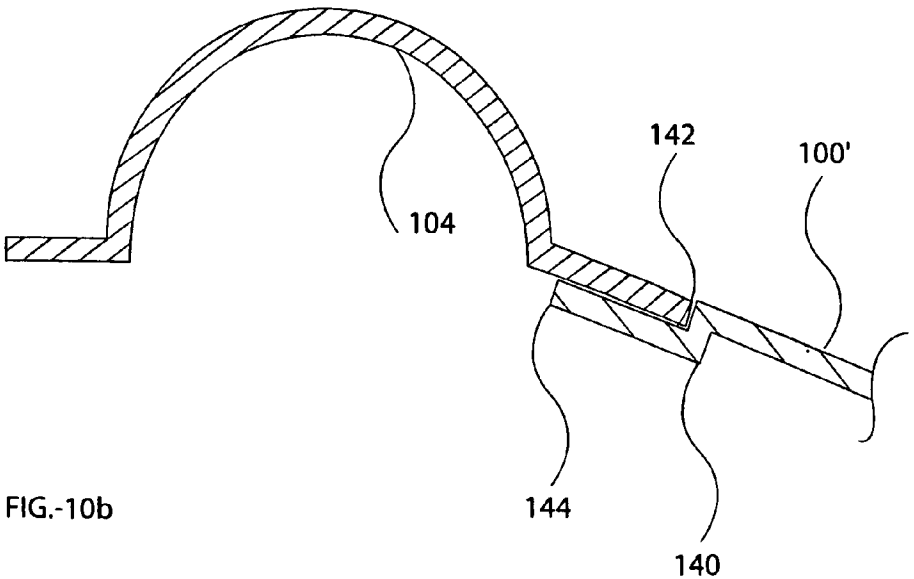
FIG. 10*b* is a close up of a slice of the assembly of the surround and cone of a of FIG. 10*a;*

FIG. 10*a* is a cross-section of the assembly of a conventional surround 104, cone 100' and voice coil bobbin 102 of another speaker of the present invention, and FIG. 10*b* is a close up of a slice of the point of attachment of the conventional surround and cone 100' of the present invention as in FIG. 10*a*. Cone 100' is similar to a conventional cone 100 with the outer edge having a double 90° downward dog leg 140 with the outermost rim 144 of cone 100'. Dog leg 140 extends beneath the inner edge of surround 104 with the blunt inner face of surround 104 abutting shoulder 142 formed between the two 90° bends of dog leg 140. When installed in a speaker basket, the under side of the inner edge of surround 104 is glued to the top of the outer rim dog leg 140 of cone 100' with the blunt inner face of surround 104 glued to shoulder 142. The interconnection of surround 104 and cone 100' can be better seen in FIG. 10*b*. Thus in a speaker with the cone 100' of FIGS. 10*a* and 10*b*, conventional surround 104 and cone 100' is positively centered, one with respect to the other with the diameter of shoulder 142 of cone 100' substantially equal to the diameter of the blunt inner face of the inner edge of surround 104.

Figure 10C:
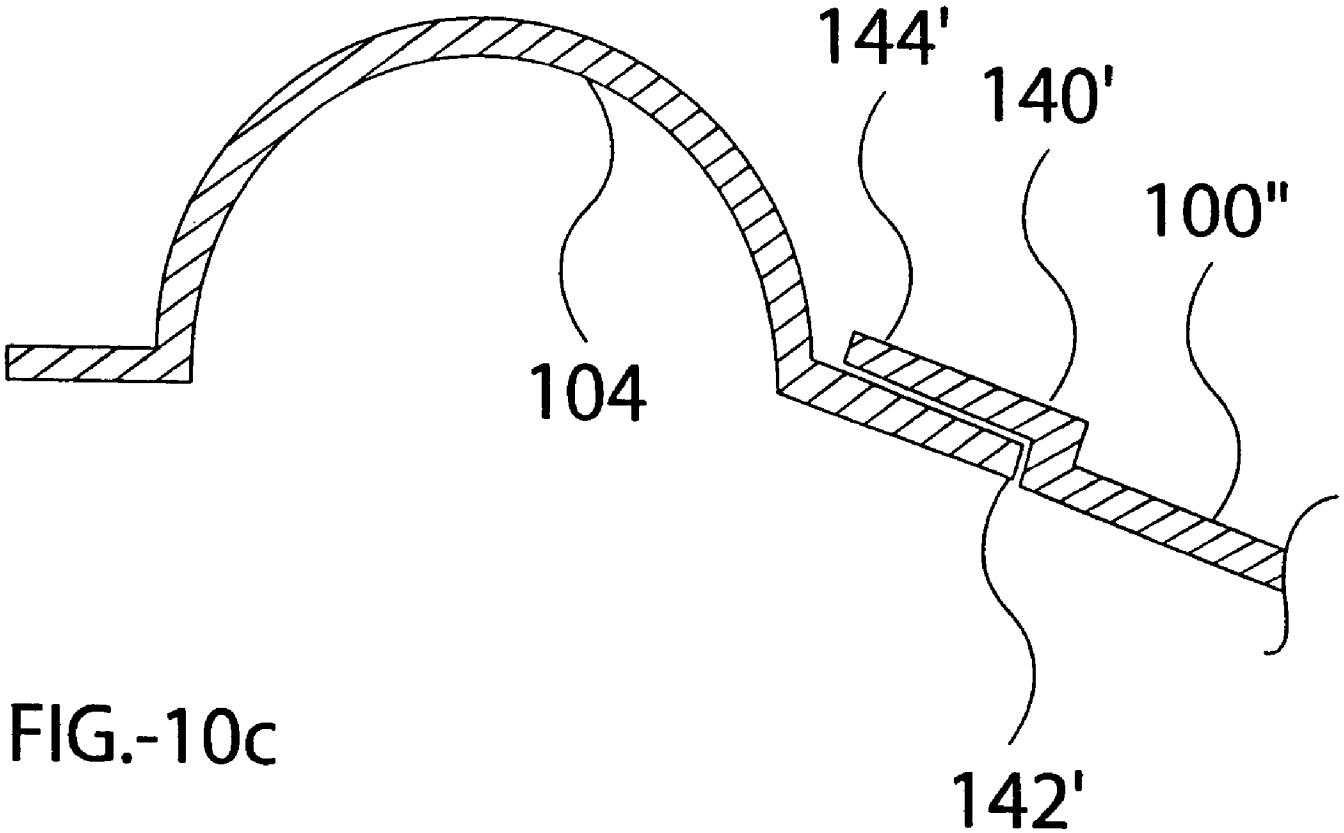
FIG. 10*c* is a close up of a slice of the assembly of the surround and a cone that is a variation of the cone of FIG. 10*b;*

FIG. 10*c* is similar to FIG. 10*b* with the double 90° dog leg 140' being a variation of dog leg 140, more specifically, dog leg 140' is the reverse of dog leg 140. In this configuration the outer most rim of cone 100" extends over the inner edge of surround 104 with the blunt edge of the inner rim of surround abutting should 142'. Here the underside of outermost rim 144' of cone 100" is glued to the top side of the inner rim of surround 104 and the blunt inner face of the surround glued to shoulder 142' of reversed dog leg 140'. In operation this configuration, cone 100" is centered with surround 104 with the same diameter limitations as discussed with respect to FIG. 10*b*.

Figure 11A:
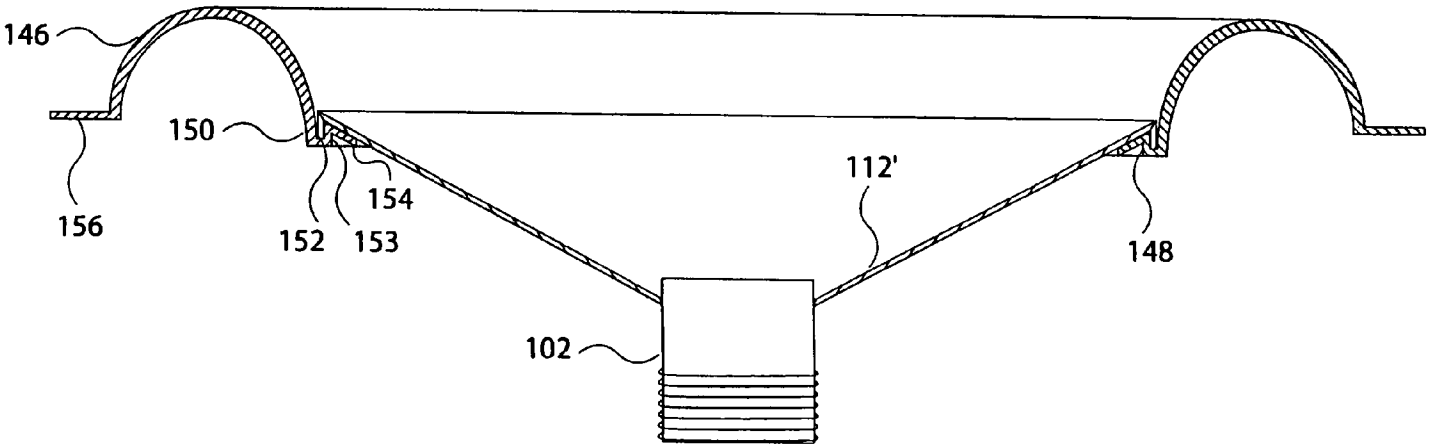
FIG. 11*a* is a cross-section of the assembly of a surround and cone of the present invention with a voice coil bobbin.
Figure 11B:
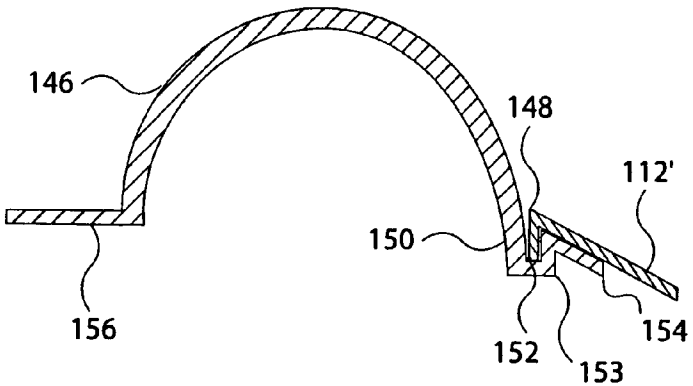
FIG. 11*b* is a close up of a slice of the assembly of the surround and cone of a of FIG. 11*a;*

FIGS. 11*a* and 11*b* illustrate yet another embodiment of the present invention in which the interfacing edges of cone 112' and surround 146 are shaped and sized to themselves provide positive centering of the cone with the surround similar to the embodiment shown in FIGS. 8*a*, 8*b* and 8*c*.

FIG. 11*a* also shows a voice coil bobbin 102 attached in the central opening defined by cone 112'. From FIGS. 11*a* and 11*b* it can be seen that cone 112' has been formed by shaping the outer edge with a short downward extending ring 148 with ring 148 extending downward a selected length and at selected angle. Surround 146 is formed with a flat outer ring 156 and a shaped inner ring 152–154 each extending away from a semi-circular main body portion 150 that is intermediate the inner and outer rings.

The semi-circular main body portion 150, beginning from the outer ring 156, extends through more than 180° (e.g., 190°) to the point where shaped inner ring 152–154 is formed. Inner ring 152–154 includes a first portion 152 has one end attached to, and extending inward at about 90°, a selected short distance from the inner most end of body portion 150. One end of a second portion 153 of the inner ring is attached to, and extends upward at about 90° a short selected distance from, a second end of first portion 152. Then one end of a third portion 154 of the inner ring is attached to, and extends inward at a selected angle from, a second end of second portion 152 so that the top side of third portion 154 mates with the underside of cone 112' assembled therewith. Surround 146 formed in this manner defines a substantially square bottomed trough between main body portion 150 and inner ring second portion 153 with first portion 152 forming the bottom of the trough.

So forming inner ring 152–154 of surround 146 results in the junction of the top surface of third ring 154 with the second end of second portion 153 being substantially 180° around the main body of surround 146 from the junction point of the outer ring 156. This being the case, surround 146 will preform substantially the same as surround 104 of FIGS. 6*a* and 6*b*, as well as the other surrounds of the various other embodiments of the present invention illustrated in FIGS. 8*a*–10*c*.

The trough is sized in depth and width to receive downward extending ring 148 of cone 112'. For example, the depth of the trough, measured from the second end of second portion 153 to the top side of the first portion 152 forming the inside bottom of the trough, at a minimum must be deep enough to receive a sufficient portion of the length of ring 148. To maximize the quality of the centering of cone 112' with surround 146, the depth of the trough should be equal to or greater than the length of ring 148. The width of the trough measured between the outer surface of the main body portion 150 of surround 146 and the inner surface of second portion 153 the inner ring must be at least the thickness of ring 148 of cone 112'. To maximize the centering of cone 112' with surround 146, the trough width should be substantially equal to the thickness of ring 148.

Additionally, the included angle formed between the second and third portions 153 and 154 of the inner ring should be substantially the same as the selected included angle between the underside of the main body of cone 112' and ring 148 to make the best fit of cone 112' with the inner ring of surround 146. With those angles being substantially the same, the underside of the main body of cone 112' is positioned to fit with the top of the third portion 154 of the inner ring to provide the best surfaces match for gluing one with the other. Similarly, that matching of the angles, together with the selection of the depth and width of the trough as discussed above, also makes for a better match of the various interacting surfaces for gluing.

As with the other embodiments of the present invention, by more positively centering cone 112' with surround 146, the wobble of voice coil bobbin 102 as it travels when the voice coil is energized.

Figure 12B:
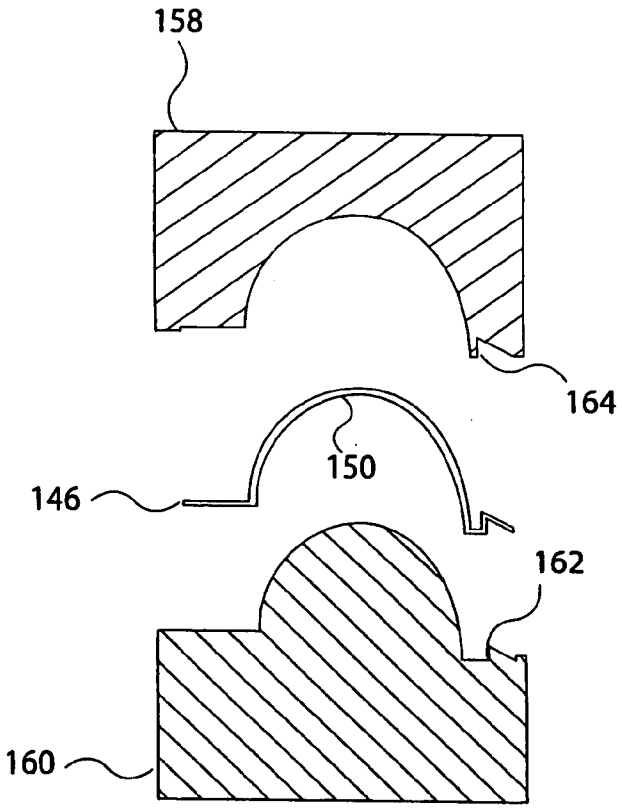
FIG. 12*b* is a slice of an exploded view of a two piece mold for forming a surround of FIGS. 11*a* and 11*b* with the surround shown intermediate the two pieces of the mold.
Figure 12A:
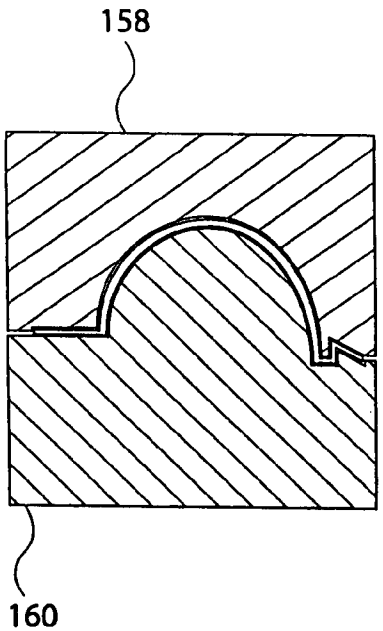
FIG. 12*a* is a slice of a closed two piece mold for forming a surround of FIGS. 11*a* and 11*b* with the surround between the two mold pieces.

FIG. 12*a* is a slice of a closed two piece mold for forming foam surround 146 of the present invention between the two mold pieces 158 and 160. FIG. 12*b* is a slice of an exploded view of a two piece mold for forming foam surround 146 of the present invention with surround 146 shown intermediate the two pieces of the mold. Thus it can be seen by comparing FIGS. 7*b* and 12*b*, the lower mold piece 160 for forming the foam surround 146 of the present invention includes a circular, square bottom groove 162 and mold extension 164 of upper mold piece 158 produces the extension of main body portion 150 and inner ring 152–154 of surround 146 of the present invention.

In each embodiment, the shape and dimensions of the channel in the surround are substantially the same as the shape and dimensions of the outer edge of the radiator. That being the case, when the radiator is attached to the surround there is a positive centering of one with respect to the other.

While the invention has been described with regard to several specific embodiments, those skilled in the art will recognize that changes can be made in form and detail without departing from the spirit and scope of the invention. For example the cone can be any desired shape: flat, slightly indented, round, elliptical, etc. Similarly while the main body of the surround is shown as having a semi-circular shape, it can have any desired shape.

What is claimed is:

1. An audio speaker comprising:

an audio radiator having an outer edge, an inner edge with the inner edge defining a central opening through said radiator, a top surface and a bottom surface, with said outer edge defined by a short downward extending ring at a first included angle with said bottom surface; and a flexible, shaped surround defining an inner opening disposed to be filled by said audio radiator and having, in cross-section, a pre-shaped, non-flat main body that extends radially through more than 180°, a flat outer ring extending outward from and attached to the main body of the surround, and a flat inner ring extending inward and attached to the main body at substantially 180° radially around the main body from the flat outer ring with a portion of the main body extending below the flat inner ring, forming a channel between the inner ring and the portion of the main body extending below the flat inner ring defining a second included angle therebetween;

wherein said first angle and said second angle complement each other and an inner most edge of the inner ring defines size and shape of said inner opening.

2. The audio speaker of claim 1 wherein an outer most portion of the radiator fits within said channel with the top of the outer most portion of the radiator abutting the under side of the flat inner ring of the surround and the short downward extending ring of the outer edge of the radiator abutting the portion of the main body of the surround that extends below the flat inner ring to positively center the surround and the radiator, one with the other.

3. The audio speaker of claim 2 wherein the outer most portion of the radiator is attached within said channel.

4. The audio speaker of claim 2 further comprising a voice coil bobbin mounted within the central opening of the radiator and attached to the inner edge defined by the central opening through the radiator, wherein a longitudinal centerline of said voice coil bobbin is coincident with a longitudinal centerline of said radiator.

5. The audio speaker of claim 1 wherein said channel has a "V" shape.

6. The audio speaker of claim 1 wherein a cross-section of said main body of the surround has a semi-circular shape.

7. The audio speaker of claim 1 wherein said first angle and said second angle are substantially equal to each other.

8. The audio speaker of claim 4 further comprising:

a basket having a bottom, upward extending sides surrounding said bottom with said sides having an upper rim forming a mouth of the basket;

a magnet assembly mounted centrally to the bottom of the basket with a longitudinal centerline of the magnet assembly coincident with a longitudinal centerline of the basket;

wherein a free end of said voice coil bobbin is inserted loosely within said magnet assembly and said flat outer ring of the surround is attached to the upper rim of said basket by so doing causing the longitudinal center lines of said surround, radiator, voice coil bobbin, magnet assembly and basket to be substantially coincident with each other.

9. An audio speaker comprising:

an audio radiator having an outer edge, an inner edge with the inner edge defining a central opening through said radiator, a top surface and a bottom surface, with said outer edge having a blunt end; and a flexible, shaped surround defining an inner opening disposed to be filled by said audio radiator and having, in cross-section, a pre-shaped, non-flat main body that extends radially through more than 180°, a flat outer ring extending outward from and attached to the main body of the surround, and a flat inner ring extending inward and attached to the main body at substantially 180° radially around the main body from the flat outer ring with a portion of the main body extending below the flat inner ring, forming a channel between the inner ring and the portion of the main body that extends below the flat inner ring;

wherein an inner most edge of the inner ring defines size and shape of said inner opening.

10. The audio speaker of claim 9 wherein an outer most portion of the radiator fits within said channel with the top of the outer most portion of the radiator abutting the under side of the flat inner ring of the surround and the blunt end of the outer edge of the radiator abutting the portion of the main body of the surround that extends below the flat inner ring to positively center the surround and the radiator, one with the other.

11. The audio speaker of claim 10 wherein the outer most portion of the radiator is attached within said channel.

12. The audio speaker of claim 10 further comprising a voice coil bobbin mounted within the central opening of the radiator and attached to the inner edge defining a central opening through the radiator, wherein a longitudinal centerline of said voice coil bobbin is coincident with a longitudinal centerline of said radiator.

13. The audio speaker of claim 9 wherein said channel has a "V" shape.

14. The audio speaker of claim 9 wherein a cross-section of said main body of the surround has a semi-circular shape.

15. The audio speaker of claim 14 further comprising:

a basket having a bottom, upward extending sides surrounding said bottom with said sides having an upper rim forming a mouth of the basket;

a magnet assembly mounted centrally to the bottom of the basket with a longitudinal centerline of the magnet assembly coincident with a longitudinal centerline of the basket;

wherein a free end of said voice coil bobbin is inserted loosely within said magnet assembly and said flat outer ring of the surround is attached to the upper rim of said basket by so doing causing the longitudinal centerlines of said surround, radiator, voice coil bobbin, magnet assembly and basket to be substantially coincident with each other.

16. An audio speaker comprising:

an audio radiator having an outer edge, an inner edge with the inner edge defining a central opening through said radiator, a top surface and a bottom surface, with said outer edge defined by a short downward extending ring at a first included angle with said bottom surface; and a flexible, shaped surround defining an inner opening disposed to be filled by said audio radiator and having, in cross-section, a pre-shaped, non-flat main body that extends radially through more than 180°, a flat outer ring extending outward from and attached to an outside edge of the main body of the surround, and a shaped inner ring extending inward and attached to an inside edge of the main body, wherein said shaped inner ring includes: a first portion having one end attached to, and extending inward at substantially 90°, a first selected short distance from the inside edge of the main body; a second portion having one end attached to, and extending upward at substantially 90°, a second selected short distance from, a second end of the first portion; and a third portion having one end attached to, and extending inward a third selected distance with a second included angle with the second portion defining a substantially square bottomed trough between the main body and the second portion with the first portion forming a bottom of the trough sized and shaped to receive said ring of said audio radiator;

wherein said first angle and said second angle complement each other and an inner most edge of the third portion of the inner ring defines size and shape of said inner opening.

17. The audio speaker of claim 16 wherein said ring of the audio radiator fits within said trough with the top of the third portion of the inner ring abutting the under side of an outer most portion of the audio radiator closest to said ring wherein an outer side of said ring abuts the main body of the surround and an inner side of said ring abuts an inside surface of said third portion to positively center the surround and the radiator, one with the other.

18. The audio speaker of claim 17 wherein the ring of the radiator is attached within said trough and to said third portion of the inner ring of the surround.

19. The audio speaker of claim 17 further comprising a voice coil bobbin mounted within the central opening of the radiator and attached to the inner edge defined by the central opening through the radiator, wherein a longitudinal centerline of said voice coil bobbin is coincident with a longitudinal centerline of said radiator.

20. The audio speaker of claim 16 wherein said trough has substantially a square inner bottom surface.

21. The audio speaker of claim 16 wherein a cross-section of said main body of the surround has a semi-circular shape.

22. The audio speaker of claim 16 wherein said first angle and said second angle are substantially equal to each other.

23. The audio speaker of claim 19 further comprising:

a basket having a bottom, upward extending sides surrounding said bottom with said sides having an upper rim forming a mouth of the basket;

a magnet assembly mounted centrally to the bottom of the basket with a longitudinal centerline of the magnet assembly coincident with a longitudinal centerline of the basket;

wherein a free end of said voice coil bobbin is inserted loosely within said magnet assembly and said flat outer ring of the surround is attached to the upper rim of said basket by so doing causing the longitudinal center lines of said surround, radiator, voice coil bobbin, magnet assembly and basket to be substantially coincident with each other.

24. An audio speaker comprising:

an audio radiator having an outer edge, an inner edge with the inner edge defining a central opening through said radiator, a top surface and a bottom surface, with an outer portion having a double dog leg in relation to an interior portion of the radiator a selected distance from the outer edge, said double dog leg forming a step of a selected height with a face of the step substantially perpendicular to the top and bottom surfaces of the radiator; and a flexible, shaped surround defining an inner opening disposed to be filled by said audio radiator and having, in cross-section, a pre-shaped, non-flat main body that extends radially through substantially 180°, a flat outer ring extending outward from and attached to an outer edge of the main body of the surround, and a flat inner ring extending inward and attached to an inner edge of the main body with said inner ring having a selected width, a selected thickness with a blunt inner edge;

wherein an inner most edge of the inner ring defines size and shape of said inner opening.

25. The audio speaker of claim 24 wherein said inner ring of the surround fits with a surface of the outer portion of the radiator with the blunt end of the inner ring in contact with said step of said radiator to positively center the surround and the radiator, one with the other.

26. The audio speaker of claim 25 wherein the outer of the radiator is attached to said inner ring of the surround.

27. The audio speaker of claim 25 further comprising a voice coil bobbin mounted within the central opening of the radiator and attached to the inner edge defined by the central opening through the radiator, wherein a longitudinal centerline of said voice coil bobbin is coincident with a longitudinal centerline of said radiator.

28. The audio speaker of claim 24 wherein a cross-section of said main body of the surround has a semi-circular shape.

29. The audio speaker of claim 24 wherein said selected distance and said selected width are substantially equal to each other, and said selected height and said selected thickness are substantially equal to each other.

30. The audio speaker of claim 27 further comprising:

a basket having a bottom, upward extending sides surrounding said bottom with said sides having an upper rim forming a mouth of the basket;

a magnet assembly mounted centrally to the bottom of the basket with a longitudinal centerline of the magnet assembly coincident with a longitudinal centerline of the basket;

wherein a free end of said voice coil bobbin is inserted loosely within said magnet assembly and said flat outer ring of the surround is attached to the upper rim of said basket by so doing causing the longitudinal center lines of said surround, radiator, voice coil bobbin, magnet assembly and basket to be substantially coincident with each other.

31. The audio speaker of claim 24 wherein said double dog leg is formed to raise an upper surface of the outer portion of the radiator above an upper surface of the interior portion of the radiator by the selected height of the step with a top surface of the inner ring of the surround in contact with a lower surface of the outer portion of the radiator with the blunt end of the inner ring in contact with said step of said radiator to positively center the surround and the radiator, one with the other.

32. The audio speaker of claim 24 wherein said double dog leg is formed to lower an upper surface of the outer portion of the radiator below an upper surface of the interior portion of the radiator by the selected height of the step with a bottom surface of the inner ring of the surround in contact with an upper surface of the outer portion of the radiator with the blunt end of the inner ring in contact with said step of said radiator to positively center the surround and the radiator, one with the other.

* * * * *